United States Patent [19]

Gabalda et al.

[11] Patent Number: 5,060,885

[45] Date of Patent: Oct. 29, 1991

[54] YARN TENSION DEVICE FOR TEXTILE MACHINES

[75] Inventors: Carlos M. Gabalda, Granges les Valence; Bernard Puaux, Chassieu, both of France

[73] Assignee: ICBT Lyon, France

[21] Appl. No.: 545,705

[22] Filed: Jun. 29, 1990

[30] Foreign Application Priority Data

Jul. 18, 1989 [FR] France ..... 89 09917

[51] Int. Cl.[5] ..... B65H 59/16

[52] U.S. Cl. ..... 242/151; 242/155 M

[58] Field of Search ..... 242/151, 152, 155 R, 242/155 M, 147 R, 147 M, 153, 154

[56] References Cited

U.S. PATENT DOCUMENTS

| | | | |
|---|---|---|---|
| 2,362,920 | 11/1944 | Moore | 242/155 R |
| 2,667,313 | 1/1954 | Klein | 242/155 R |
| 2,978,203 | 4/1961 | Westall et al. | 242/155 M |
| 3,026,063 | 3/1962 | Seidl | 242/155 M |
| 3,034,744 | 5/1962 | Bancroft | 242/155 M |
| 4,848,078 | 7/1989 | White et al. | 242/155 M X |

FOREIGN PATENT DOCUMENTS

| | | |
|---|---|---|
| 3624370 | 1/1987 | Fed. Rep. of Germany . |
| 2145056 | 2/1973 | France . |
| 2167957 | 8/1973 | France . |
| 2295900 | 7/1976 | France . |
| 2531051 | 2/1984 | France . |

*Primary Examiner*—Stanley N. Gilreath

*Attorney, Agent, or Firm*—Parkhurst, Wendel & Rossi

[57] ABSTRACT

A yarn tension device of the type including three rollers mounted freely rotatably on a support housing, at least one of these rollers being subjected to the action of an adjustable permanent-magnet braking system (or magnetic brake), and the yarn, during its movement being deflected around the periphery of the rollers, the movement of the yarn upstream and downstream of the tension assembly being executed in a common direction called the "running axis". The rollers are mounted on the support housing in such a way that:

first and second rollers, called "entry rollers" are arranged in the vicinity of the yarn introduction zone such that their axes are on either side of the running axis and are maintained in contact, at least one of these rollers having an adjustable braking device; and a third roller, called an "exit roller", itself is positioned downstream of the first and second rollers in the direction of travel of the yarn, its surface being tangent to the running axis.

7 Claims, 4 Drawing Sheets

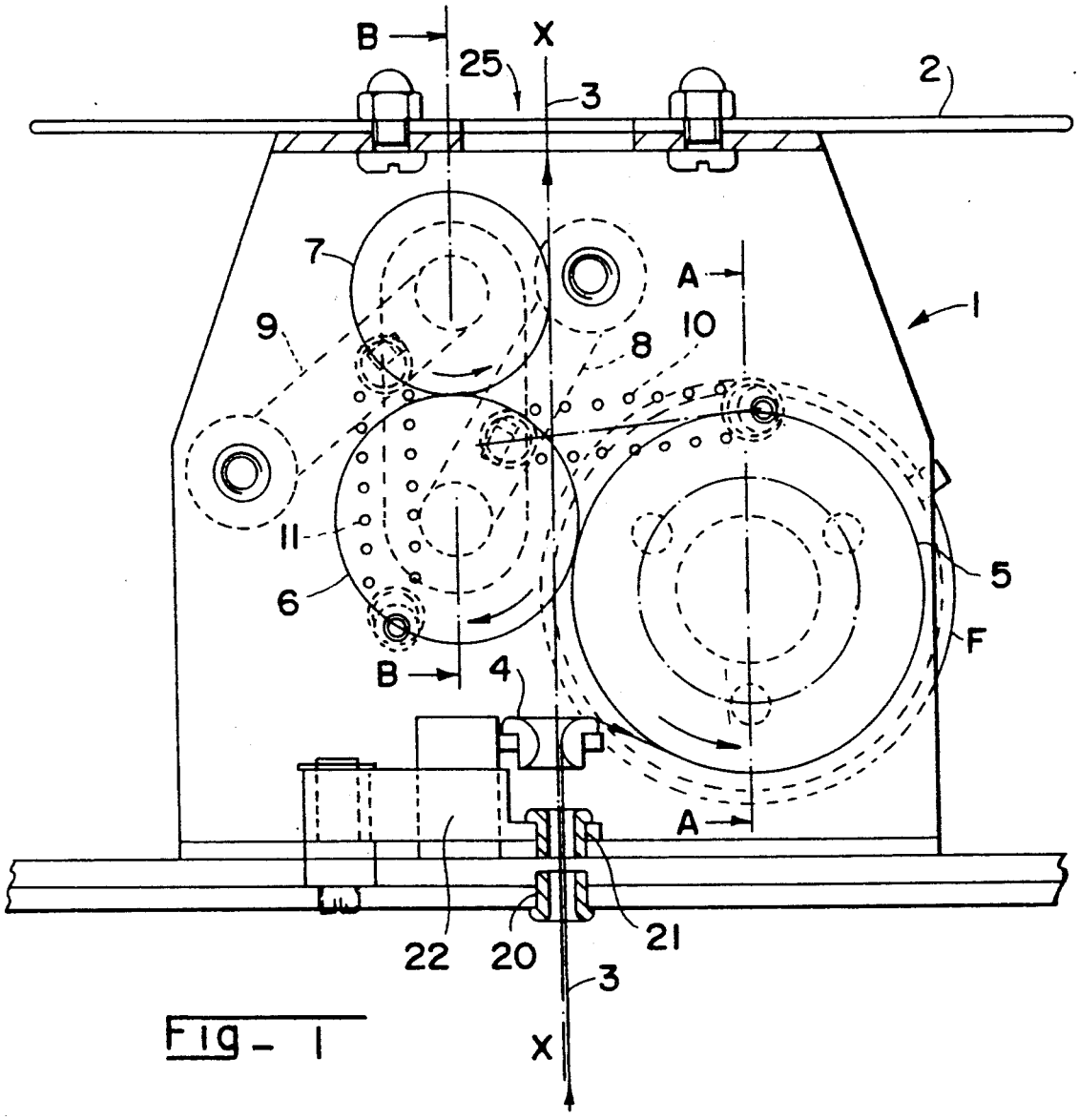
Fig- 1
Fig- 2
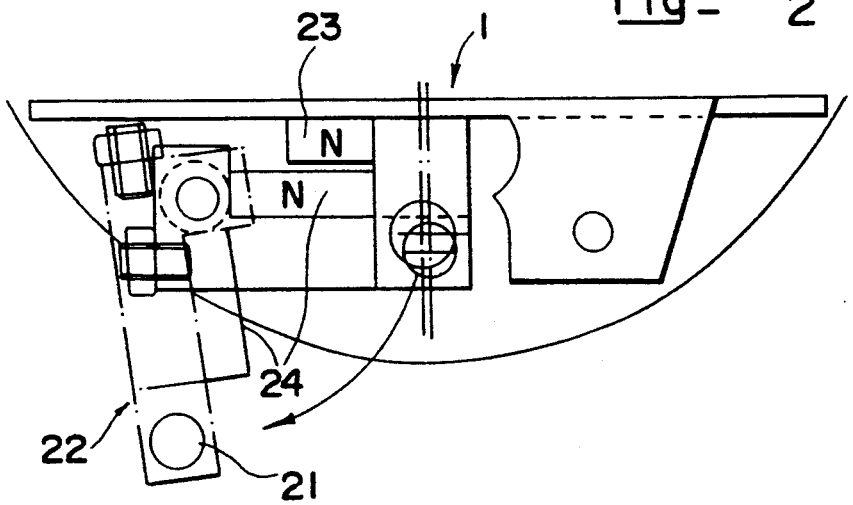

YARN TENSION DEVICE FOR TEXTILE MACHINES

The present invention relates to a new type of yarn tension device which can be used on any type of textile equipment and more particularly on machines making it possible for yarns of any type to be twisted and/or assembled by twisting.

During the various conversion operations which a yarn undergoes during its manufacture, it is essential to impart to it as uniform and as constant a tension as possible. For this purpose, many solutions for tension devices have been provided hitherto, and of these mention may be made of that cited in the preamble of French Patent No. 2,145,056, which involves bringing the moving yarn into contact with the surface of a pulley or roller subjected to the action of braking means consisting of an eddy-current brake, as disclosed in French Patent 2,167,957, The yarn-guiding pulley is braked by means of an assembly comprising a magnet of an even number of magnetic poles. This magnet is located opposite to a disk which has a face pierced by a plurality of holes and which supports the yarn-guiding pulley. The braking of the pulley is obtained by varying the distance between the disk and the magnet.

However, these solutions, which can be summarized by the expression "drum braked by a magnetic brake", imply having a "drum" of relatively large diameter (of the order of 80 to 100 mm) if a good surface of adhesion for the yarn is to be obtained. Moreover, during starting, they have the disadvantage of giving rise to tension jolts. Finally, above all, these solutions require a prebraking, without which there can be no adhesion of the yarn on the pulley.

To solve these problems, it has been proposed, as in FR-A-2,295,900, to provide tension devices comprising two rollers which are mounted rotatably in a housing and which touch one another along their circumferences with an adjustable pressure, at least one of these rollers being covered with a band made of a material having the elasticity of rubber, and the yarn to be tensioned being guided in such a way that it drives the two rollers when it passes through the device. However, the disadvantage of such a device, widely used at the present time, is that, particularly because of current high production speeds, a heating of the rubber layer occurs during operation, this variation having an effect on the quality of the yarn produced.

It has also been proposed, particularly in order to obtain a progressive tensioning during the starting of the machine and as constant a tension as possible during normal operation, to provide tension devices comprising a plurality of rollers mounted freely rotatably on a support housing and subjected to the action of braking means (magnetic brake), yarn guides being provided on the housing upstream and downstream of the rollers, as seen in the direction of run of the yarn, so that the latter is deflected around the periphery of the rollers during its passage through the tension device.

However, such devices still have some disadvantages, of which one that can be mentioned is that the exit deflection utilized as a brake multiplier also gives rise to a multiplication of the occasional running jolts of the upstream reel. Furthermore, the conditions of friction on the eyes can vary as a result of the change of the surface state, attributable particularly to the greasing deposit, thereby causing a variation of the exit tension of the yarn.

Finally, the means for braking the rollers are generally incorporated in these, and they do not make it possible to adjust the tension during operation.

Now a new type of tension device has been found, this being the subject of the present invention, which overcomes the disadvantages of the prior solutions particularly in that it eliminates any risk of transmission of the running jolts which can occur upstream of the tension device, the exit tension likewise being maintained at a constant value not liable to vary during operation.

Moreover, according to a preferred embodiment, the braking means are designed so as to allow an adjustment during operation.

In general terms, the tension device according to the invention, of the type comprising rollers mounted freely rotatably on a support housing, at least one of these rollers being subjected to the action of an adjustable permanent-magnet braking system (or magnetic brake), and the yarn, during its movement, being deflected around the periphery of the rollers, the movement of the yarn upstream and downstream of the tension assembly being executed in a common direction called the "running axis", is defined in that the rollers are three in number and are mounted on the support housing as follows:

Two of these rollers, called "entry rollers", are arranged in the vicinity of the yarn introduction zone such that their axes are on either side of the running axis, at least one of these rollers having an adjustable braking device, and their mounting being carried out in such a way that they are maintained in tangential contact with one another.

A third roller called a "exit roller", is positioned downstream of the abovementioned rollers in the direction of travel of the yarn, its surface being tangent to the running axis.

In the device according to the invention, the entry rollers are preferably rubberized rollers, the exit roller itself having a hard (for example, metallic) surface in order to withstand the friction attributable to the torsion.

Furthermore, the device according to the invention is preferably associated, in the region of the yarn entry zone, with a pretension device which is likewise the subject of the present invention and which makes it possible to absorb the unwinding jolts and prevents them from having an effect downstream.

Various embodiments of the device according to the invention can be considered.

Thus, according to a first embodiment, the three rollers are maintained in mutual contact, the second and third rollers being mounted on the housing by means of a lever (or the like) subjected to the action of a return means (spring, etc.).

According to only the first two rollers are maintained in mutual contact, as before the second roller being mounted on the housing by means of an articulated arm subjected to the action of a return spring, and the third roller itself being mounted in a fixed axis on the housing.

According to another variant in which the three rollers are likewise maintained in mutual contact, the first and third rollers are mounted for free rotation about a fixed shaft, the second roller being itself maintained under pressure against the two aforementioned rollers by magnetism by means of a magnet (or any other equivalent system), it being possible for the second roller to be either entirely free and disunited from the supporting housing or mounted on this housing by any guidance system allowing it full freedom to implement its contact with the other two rollers.

As a result of such design for a tension device it is possible to eliminate all the occasional running jolts which can occur upstream, and moreover the tension is maintained at an exactly specific constant value during normal operation.

However, the invention and the advantages which it affords will be understood better from the exemplary embodiments given below as a non-limiting indication and illustrated in the accompanying diagrams in which :

FIG. 1 is a diagrammatic sectional and elevation view of a tension device according to the invention.

FIG. 2 is a top view showing an embodiment of an accessory pretension device associated with a tension device according to the invention and making it possible to eliminate all the tensioning jolts during unwinding.

Figure 3:
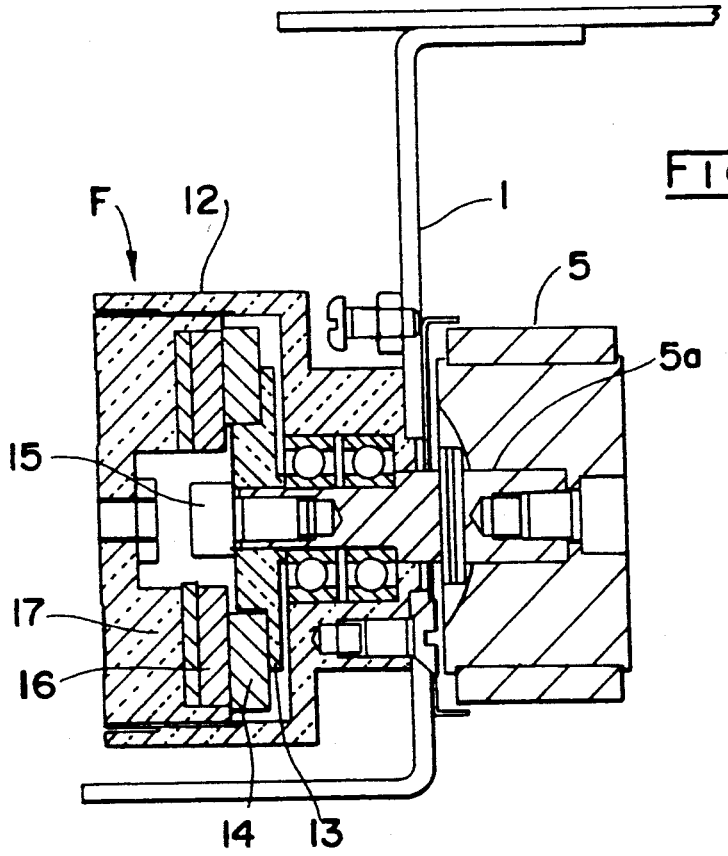
Figure 4:
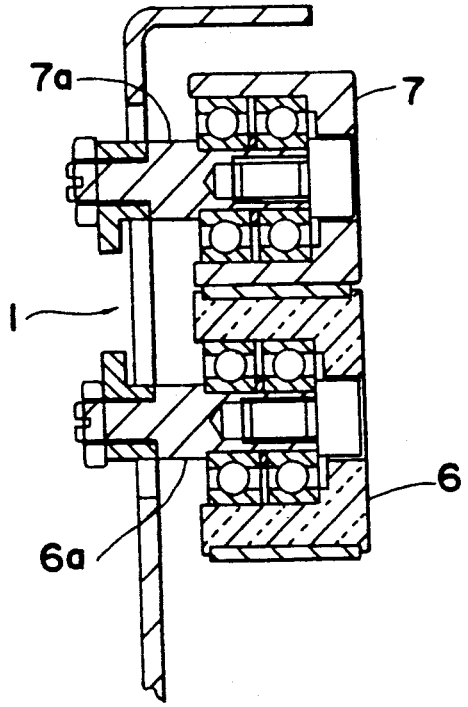

FIGS. 3 and 4 are sectional views along the axes 3—3 and 4—4 of FIG. 1, showing the structure of the rollers involved in the production of a device according to the invention.

Figure 5:
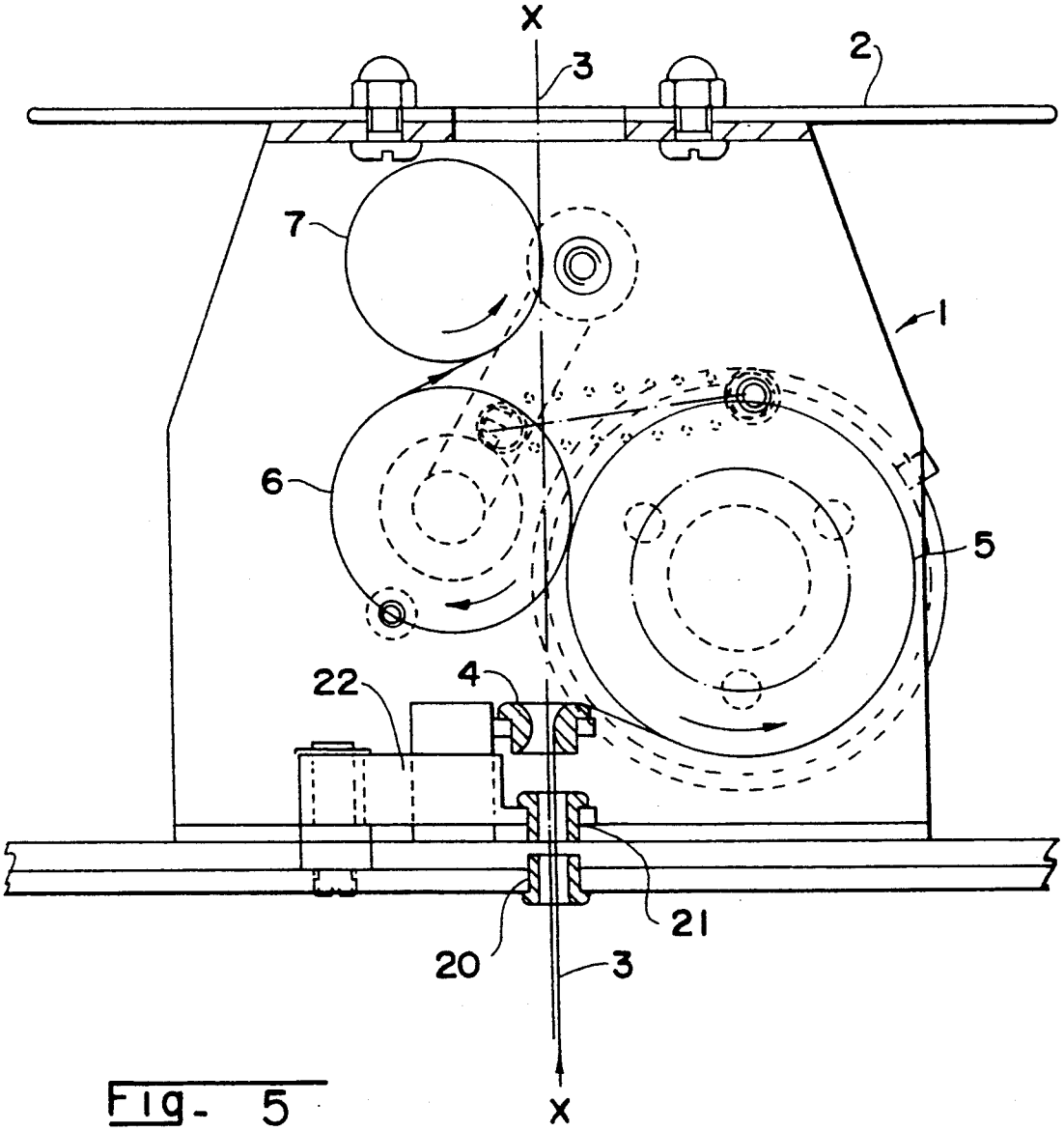

FIG. 5 illustrates another embodiment of a tension device according to the invention in a manner similar to FIG. 1.

Figure 6:
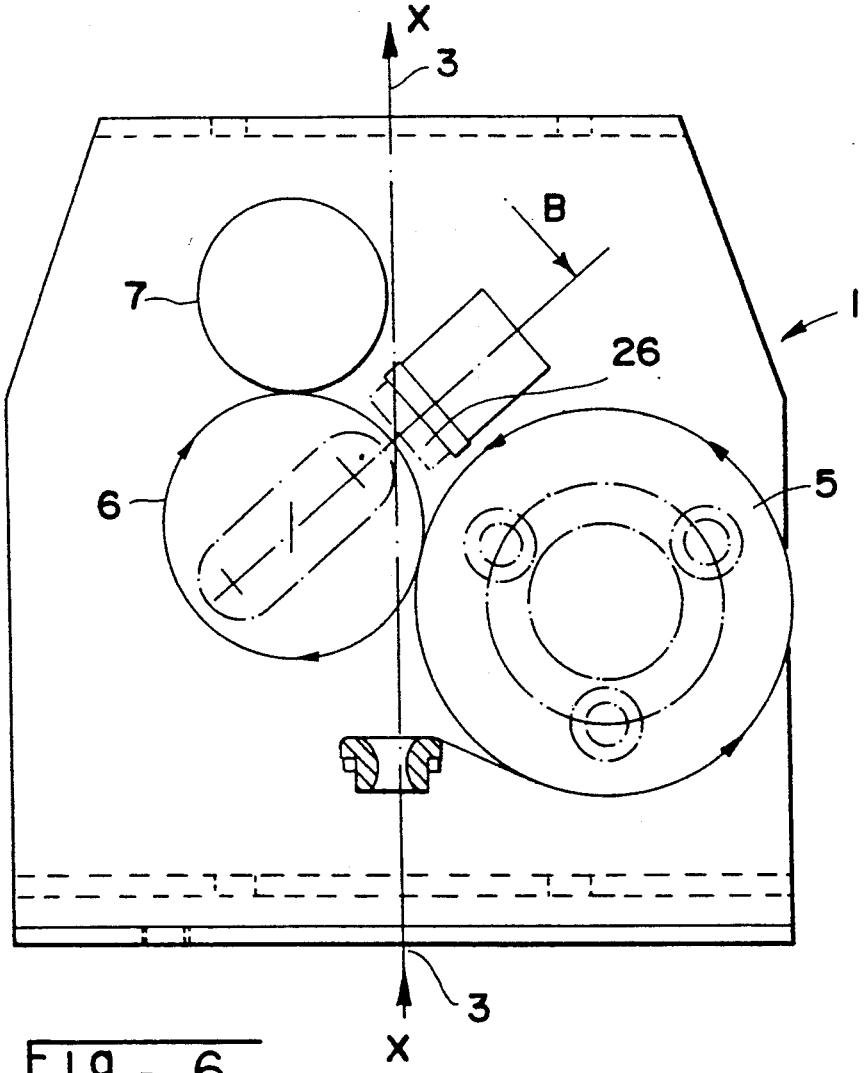
Figure 7:
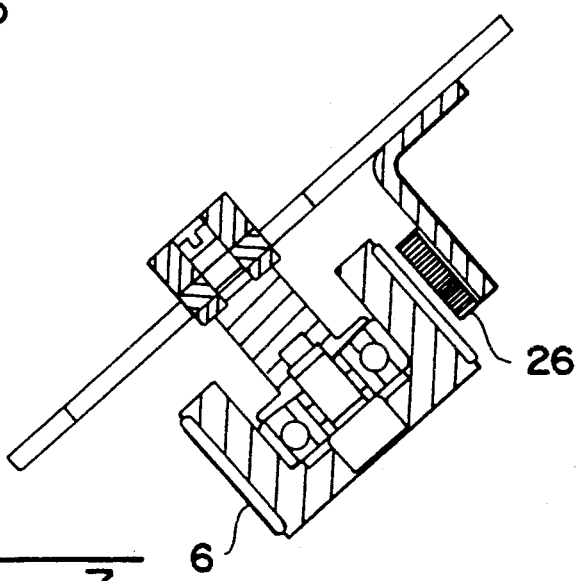

FIG. 6 illustrates in a similar manner to FIG. 1 a variant according to which the three rollers are maintained in mutual contact, FIG. 7 being a detail view in cross-section according to axis 7—7 of FIG. 6 illustrating the manner in which this contacting between the rollers is implemented.

In the rest of the description, the yarn tension device according to the invention will be described with the non-limiting understanding that the path of the yarn upstream and downstream of the said tension device is vertical.

Moreover, in the two embodiments illustrated, the same elements are designated by the same reference numerals.

In the first embodiment illustrated in FIGS. 1 to 4, the tension device according to the invention consists of a plurality of rollers which are mounted freely rotatably on a support housing designated by the general reference numeral (1) and itself fastened to the frame (2) of the machine.

In such a device, the yarn (3) which is to be retwisted comes from a supply source (not shown) and enters the support housing (1) via a guide eye (4), is then deflected around the rollers and leaves at (25) in order to be conveyed to the rewinding system (not shown). The run of the yarn upstream and downstream of the tension device is executed along an axis XX designated in the rest of the description by the expression "running axis".

According to the invention, the rollers are three in number (5, 6 and 7). Each roller is mounted in a known way on the support housing (1), in such a way that the yarn drives them in rotation during its passage. Braking means are associated with at least one of these rollers, in this particular case with the roller (5), one embodiment, allowing adjustment during operation and likewise forming part of the invention, preferably being associated with the first roller (5). The structure of such a braking element will be seen in more detail in the rest of the description.

To prevent the tension jolts caused upstream of the device (1) during the guidance of the yarn from having an effect, the rollers (5, 6 and 7) are mounted on the support housing (1) in such a way that:

the first two rollers (5,6) are arranged in the vicinity of the entry guide eye (4) such that their axes are on either side of the running axis (XX) of the yarn;

the third roller (7) is itself mounted above the second roller (6) and is arranged in such a way that its surface is tangent to the running axis (XX). Thus, at the exit of the tension apparatus the yarn experiences no deflection and leaves directly.

According to the first embodiment illustrated in FIG. 1, the three rollers are in mutual contact, the second roller (6) and the third roller (7) being mounted on pivoting arms (8, 9) subjected to the action of return springs (10, 11) merely indicated diagrammatically in FIG. 1. The two rollers (5, 6) are covered with a layer of rubber, whilst the roller (7) itself has a hard surface, preferably of metal.

In the preferred embodiment of FIG. 1, the roller (7) performs the function of blocking the twist run-back. Moreover, since it is maintained in contact with the second roller (6); it makes it possible to ensure that the yarn (3) is held, even when stopped.

In the version illustrated in FIG. 5, the third roller (7) is not maintained in contact with the roller (6) but is mounted freely rotatably on a stationary axle. This embodiment makes it possible to simplify the design of the tension device, but in contrast the yarn is not held perfectly, when stopped, as in the preferred embodiment.

In the variant illustrated in FIGS. 6 and 7, the third roller (7) is mounted for free rotation on a fixed shaft, but is likewise in contact with the second roller (6). The yarn is therefore held perfectly when stopped. As in the preferred embodiment illustrated by FIG. 1, the second roller (6) is in contact with the entrance roller (5) and the third exit roller (7). This second roller (6) is maintained under pressure against the other two by magnetism, by means of a magnet (26), or by any other system permitting the ensuring of its contact with the other two rollers. In such an embodiment, the second roller (6) may be entirely free and disunited from the supporting housing (1) or from any other part attached thereto; the latter may likewise be integral with the supporting block (1) by means of any guidance system allowing it full freedom to implement its contact with the rollers (5) and (7). Such an embodiment permits the simplification of the design of the tensioning device. FIGS. 3 and 4 are sections taken along the axes 3—3 and 4—4, respectively, of FIG. 1, showing in more detail the structure of the rollers (5, 6 and 7) of the yarn tension device according to the invention. It is appropriate to note that in the version illustrated in FIG. 5 the only difference is that the third roller (7) is not maintained in contact with the roller (6).

Referring to these diagrams, each roller is mounted on support housing (1) by means of bearings carried by supporting axles (5*a*, 6*a*, 7*a*). As apparent from FIG. 3, the entry roller (5) is associated with a braking device designated by the general reference (F) and is adjustable during operation. This braking device is of the permanent-magnet hysteresis type. Any other equivalent device could, of course, be used. In the embodiment illustrated, this braking device (F) is mounted on the other side of the housing (1) in relation to the roller (5) It consists essentially of a cage-shaped stationary body

(12) centered on the axle (5a) of the roller (5), a bearing being interposed between this body (12) and the axle (5a). A disk (13) having a hysteresis washer (14) is fastened to the end of the axle (5a) by means of a screw (15). Located opposite this disk is a set of magnets (16) mounted on a screw-threaded ring (17) which can be moved inside the stationary body (12) in a direction of the axle (5a), for example, so as to modify the flux gap between the magnets (16) and the hysteresis washer (14).

Although, in most cases a single braking device associated with the first roller (5) is sufficient, it is also possible to consider associating an additional braking element, not adjustable during operation, with the second roller (6) and indeed even with the third roller (7).

Furthermore, the device according to the invention is preferably associated with an assembly making it possible to eliminate the tension jolts occurring upstream of the entry eye (4). Such a compensator assembly consists essentially of two additional eyes (20, 21) located at the entrance of the tension device in the running axis XX. One of the eyes (21) is mounted on a pivoting arm (see FIG. 2), whilst the second is mounted in a stationary manner on the base of the housing (1). Two magnets (23, 24) are mounted one on the base of the housing (1) (magnet (23)) and the other (24) on the pivoting arm (22). These two magnets are arranged in such a way that their faces of the same polarity confront one another. Thus, the arm (22) tends to be pushed back, as represented by dot-and-dash lines in FIG. 2, and when the yarn (3) passes a variable deflection it is therefore possible to eliminate the tension jolts formed upstream of the entry eye (4).

Such a tension device of simple and especially effective design makes it possible to ensure a uniform and constant tension of the yarn, without any variation during operation. Moreover, by, means of the externally accessible braking system which at least one of the rollers possesses, it is possible to make adjustments during operation. Such a device can be used on any type of textile equipment.

Of course, the invention is not limited to the exemplary embodiments, but embraces all their alternative versions provided in the same spirit.

We claim:

1. A device for maintaining yarn in tension, comprising:

a support housing having a yarn zone and a yarn exit zone, wherein a running axis of the yarn traverses said support housing between said yarn entrance zone and said yarn exit zone;

a first roller which is freely rotatably mounted on said support housing and a second roller, said first roller and said second roller being arranged adjacent too said yarn entrance zone such that a central axis of revolution of said first roller and a central axis of revolution of said second roller are disposed on either side of the running axis;

means for braking at least one of said first roller and said second roller; and a third roller which is freely rotatably mounted on said support housing adjacent to said yarn exit zone and downstream of said first roller and said second roller with respect to a direction of travel of the yarn, wherein a periphery of said third roller is tangential to the running axis, and peripheral surfaces of said first roller, said second roller and said third roller are maintained in tangential contact with each other, the yarn being deflected around the peripheral surfaces between said yarn entrance zone and said yarn exit zone.

2. The device of claim 1, wherein the peripheral surface of said first roller and said second roller comprise a rubberized material and the peripheral surface of said third roller comprises a hard material.

3. The device of claim 1, further comprising levers for mounting said second roller and said third roller to said support housing, and springs for acting on said levers.

4. The device of claim 1, further comprising means for urging said second roller against said first roller and said third roller, wherein said second roller is either mounted to said support housing of is disunited from said support housing via means for urging said second roller into contact with said first roller and said third roller.

5. The device of claim 1, wherein said braking means comprises:

a cage-shaped stationary body centered around an axle which is connected at one end to a roller;

a bearing interposed between said body and said axle;

a disk including a hysteresis washer which is fastened to the other end of said axle by a screw; and a set of magnets mounted opposite to said hysteresis washer on a screw-threaded ring which is centered around a direction of said axle and is movable in said direction within said body for changing a flux gap between said magnets and said hysteresis washer.

6. The device of claim 1, further comprising a pretension device for absorbing unwinding jolts of the yarn so that said jolts are eliminated downstream of said device with respect to the direction of travel of the yarn.

7. The device of claim 6, wherein said pretension device comprises:

two eyes arranged at said entrance zone;

a pivoting arm disposed adjacent to said support housing, wherein one of said eyes is mounted on said support housing and the other of said eyes is mounted on said pivoting arm; and magnets mounted on said support housing and on said pivoting arms, respectively, wherein surfaces of each of said magnets which have the same polarity are disposed to face each other.

* * * * *